US009746253B2

(12) United States Patent
Blomgren et al.

(10) Patent No.: US 9,746,253 B2
(45) Date of Patent: Aug. 29, 2017

(54) HEAT EXCHANGER

(75) Inventors: Fredrik Blomgren, Malmö (SE); Magnus Nilsson, Hässleholm (SE)

(73) Assignee: ALFA LAVAL CORPORATE AB, Lund (SE)

( * ) Notice: Subject to any disclaimer, the term of this patent is extended or adjusted under 35 U.S.C. 154(b) by 864 days.

(21) Appl. No.: 13/131,309

(22) PCT Filed: Nov. 25, 2009

(86) PCT No.: PCT/SE2009/051334
§ 371 (c)(1),
(2), (4) Date: Jun. 21, 2011

(87) PCT Pub. No.: WO2010/064975
PCT Pub. Date: Jun. 10, 2010

(65) Prior Publication Data

US 2011/0240273 A1 Oct. 6, 2011

(30) Foreign Application Priority Data

Dec. 3, 2008 (SE) ..... 0802520

(51) Int. Cl.
*F28F 3/08* (2006.01)
*F28F 3/14* (2006.01)
*F28F 11/06* (2006.01)

(52) U.S. Cl.
CPC ..... *F28F 3/083* (2013.01); *F28F 2280/04* (2013.01)

(58) Field of Classification Search
CPC .... F28F 3/086; F28F 3/08; F28F 3/046; F28F 3/10; F28F 3/044; F28F 3/042; F28D 1/03; F28D 1/0308; F28D 1/0325
(Continued)

(56) References Cited

U.S. PATENT DOCUMENTS 5,069,276 A * 12/1991 Seidel ..... F28D 9/0037 165/166
5,332,032 A * 7/1994 Beddome et al. ..... 165/153
(Continued)

FOREIGN PATENT DOCUMENTS

AT WO 2007009141 A1 * 1/2007 ..... B01D 25/164
CN 1102287 5/1995
(Continued)

OTHER PUBLICATIONS

Form PCT/ISA/237 (Written Opinion) for application No. PCT/SE2009/051334, Oct. 5, 2010, 5 pages.
(Continued)

*Primary Examiner* — Adam J Eiseman
*Assistant Examiner* — Jason Thompson
(74) *Attorney, Agent, or Firm* — Buchanan Ingersoll & Rooney PC

(57) ABSTRACT

A heat exchanger plate, where the plate is provided with a heat transfer surface having a corrugated pattern with a plurality of ridges and valleys, and where the heat exchanger plate is provided with a plurality of guiding sections, and where each guiding section has a first guiding surface and a second guiding surface, where the first and second guiding surfaces are perpendicular to each other. A heat exchanger having a plurality of heat exchanger plates is also disclosed. The advantage of this heat exchanger plate is that it allows for an improved alignment of the heat exchanger plates.

16 Claims, 4 Drawing Sheets

(58) Field of Classification Search
USPC ..... 165/167, 170, 166, 76, 78, 79
See application file for complete search history.

(56) References Cited

U.S. PATENT DOCUMENTS

| | | | | |
|---|---|---|---|---|
| 5,392,849 | A | 2/1995 | Matsunaga et al. | |
| 5,924,484 | A * | 7/1999 | Andersson et al. | 165/167 |
| 5,967,227 | A * | 10/1999 | Jensen et al. | 165/78 |
| 5,992,510 | A * | 11/1999 | Kallrot | 165/78 |
| 6,935,415 | B1 | 8/2005 | Peterson et al. | |
| 6,973,960 | B1 | 12/2005 | Seidel | |
| 2004/0069473 | A1* | 4/2004 | Blomgren et al. | 165/167 |
| 2005/0039895 | A1 | 2/2005 | Inaba et al. | |
| 2006/0032621 | A1* | 2/2006 | Martin et al. | 165/167 |
| 2006/0048927 | A1* | 3/2006 | Blomgren | 165/167 |
| 2006/0278382 | A1* | 12/2006 | Bhatti et al. | 165/152 |
| 2007/0089872 | A1 | 4/2007 | Hou | |
| 2007/0261834 | A1* | 11/2007 | Yang et al. | 165/167 |
| 2008/0196873 | A1* | 8/2008 | Svensson | 165/167 |
| 2008/0196874 | A1* | 8/2008 | Bertilsson et al. | 165/167 |

FOREIGN PATENT DOCUMENTS

| | | | |
|---|---|---|---|
| CN | 1605013 | | 4/2005 |
| EP | 450822 | A1 | 10/1991 |
| EP | 0 830 556 | B1 | 1/2000 |
| GB | 1035170 | A | 7/1966 |
| GB | 1128108 | A | 9/1968 |
| GB | 2107845 | A | 5/1983 |
| JP | 08-42988 | | 2/1996 |
| JP | 11287582 | A | 10/1999 |
| JP | 2004-03824 | | 1/2004 |
| JP | 2004-3824 | A | 1/2004 |
| JP | 2004003824 | A | 1/2004 |
| JP | 2005-55074 | A | 3/2005 |
| KR | 20-1998-03874 | | 9/1998 |
| RU | 2 249 290 | | 2/2004 |
| RU | 2008 130 129 | | 12/2006 |
| WO | WO8809474 | A1 | 12/1988 |
| WO | WO9639605 | A1 | 12/1996 |
| WO | 2006/017925 | A2 | 2/2006 |

OTHER PUBLICATIONS

Second Office Action issued by the Chinese Patent Office on Jun. 3, 2013, in the corresponding Chinese Patent Application No. 200980149050.3, and an English translation of the Office Action. (13 pages).

Search Report issued by the Chinese Patent Office on May 24, 2013, in the corresponding Chinese Patent Application No. 200980149050.3, and an English translation of the Search Report (4 pages).

Decision on Grant for RU 2011127142/06/040181 dated Jul. 30, 2012 in English.

Rejection Notice for Japanese Application No. 2011-539477 dated Nov. 6, 2012 with English translation.

Notice of Preliminary Rejection for KR Application No. 10-2011-7012666 dated Oct. 30, 2012 with English translation.

Office Action issued by the Japanese Patent Office on Mar. 26, 2013, in the corresponding Japanese Patent Application No. 2011-539477, and an English translation of the Office Action. (4 pages).

Search Report for CN Application No. 200980149050.3 dated Aug. 31, 2012 in English.

Office Action issued on Jun. 3, 2016, by the European Patent Office in corresponding European Patent Application No. 09764622.8. (7 pages).

* cited by examiner

HEAT EXCHANGER

TECHNICAL FIELD

The present invention relates to a heat exchanger plate having improved guiding means that will improve the alignment of the heat exchanger plates in a heat exchanger. The invention further relates to a heat exchanger comprising a plurality of heat exchanger plates.

BACKGROUND ART

A conventional type of plate heat exchanger use heat transfer plates fitted with gaskets that seal off each channel from the next, and direct the fluids into alternate flow channels. This type of plate heat exchanger is used throughout industry as standard equipment for efficient heating, cooling, heat recovery, condensation and evaporation.

Such a plate heat exchanger consists of a series of thin corrugated heat exchanger plates fitted with gaskets. The plates are then compressed together between a frame plate and a pressure plate in order to create an arrangement of parallel flow channels. The two fluids flow in alternate channels which gives a large surface area over which the transfer of heat energy from one fluid to the other can take place. The channels are provided with different corrugated patterns designed to induce maximum turbulence in both the fluid flows in order to make heat transfer as efficient as possible. The two different fluids normally enter and leave at the top and bottom of the heat exchanger, respectively. This is known as the counter-current flow principle.

One advantage with heat exchangers having gaskets compared with brazed heat exchangers is that it is easy to assemble and separate the heat exchanger plates. This is of advantage e.g. when they need to be cleaned or when the capacity of the heat exchanger is to be adjusted. This is done by simply adding or removing heat exchanger plates when required.

In one type of plate heat exchangers, the heat exchanger comprises one type of plate, which is mounted with every other plate rotated 180 degrees to form two different channels for the fluids, one channel for the cooling medium and one channel for the product that is to be cooled. A sealing is provided between each plate. Such an arrangement is cost-effective and works for many applications. Each plate is provided with ridges and valleys in order to on one hand provide a mechanical stiffness and on the other hand to improve the heat transfer to the liquid. The plates will bear on each other where the patterns of the plates meet each other, which will improve the mechanical stiffness of the plate package. This is important especially when the fluids have different pressures. For this type of heat exchanger, the inlet and outlet opening regions must be adapted so that they work for both channels.

It is also important that the heat exchanger plates are aligned properly in relation to each other, both in the vertical as well as in the horizontal direction. This is especially important for heat exchangers having a high number of heat exchanger plates stacked together, since a small misalignment may multiply with the number of heat exchanger plates. Misaligned heat exchanger plates may result in leakage in a flow channel due to misalignment of the sealing gasket, or even to damage to the heat exchanger.

There are different ways to align the heat exchanger plates. One common way is to use guiding bars, normally at the upper and lower sides of the heat exchanger plates. Such a solution may not give a sufficiently high precision, such that other alignment means are also required. One common solution of obtaining an alignment of the heat exchanger plates is to provide a guiding surface at the corners of the heat exchanger plate.

The corner regions of heat exchanger plates are commonly rounded, i.e. provided with a radius. It is known to provide rounded guiding surfaces at the corners, having a radius with the same centre as the port openings. In this way, the upper edge of one plate bears on the lower edge of another plate when they are stacked. At the same time, the corner region must, apart from guiding the plates, also stabilise the gasket groove around the port opening. The guiding surfaces will thus be rather small, and may comprise only a few small surfaces where the stabilising nuts of one plate bear against the rear side of another plate. This solution may work for larger plates, where there is space enough for a rounded guiding surface. The angle of the rounded guiding surface is normally in the region of up to 70 to 85 degrees.

On smaller plates, there may not be room for such a solution. It may be that there is only room for a guiding surface having a smaller angle or the radius of the guiding surface may have to be rather small. Both these arrangements will deteriorate the possibility to align the plates in a proper way.

U.S. Pat. No. 5,967,227-A disclose a heat exchanger plate having a guiding collar. The guiding collar is concave, having a negative radius compared with the outer corner of the plate.

EP-0 450 822-A1 discloses a heat exchanger plate having a tapered collar included in the guiding bar recessions. The tapered collar, which may be of a somewhat triangular shape, is intended to align the heat exchanger plates.

JP-11287582-A discloses a heat exchanger plate having projecting guiding parts incorporated in the sealing gasket groove around the port openings.

These known solutions show different types of alignment aids that may work well in specific applications. They are however intended for larger heat exchanger plates, where there is space enough to incorporate such solutions. There is thus room for improved guiding means that are also intended for the use on smaller heat exchanger plates.

DISCLOSURE OF INVENTION

An object of the invention is therefore to provide a heat exchanger plate having improved guiding means. A further object of the invention is to provide a heat exchanger in which the alignment of the heat exchanger plates is improved.

The solution to the problem according to the invention is described in the characterizing part of claim 1. Claims 2 to 8 contain advantageous embodiments of the heat exchanger plate. Claim 9 contain an advantageous heat exchanger.

With a heat exchanger plate, where the heat exchanger plate is provided with a heat transfer surface having a corrugated pattern with a plurality of ridges and valleys, and where the heat exchanger plate is provided with a plurality of guiding sections, the object of the invention is achieved in that each guiding section comprises a first guiding surface and a second guiding surface, where the first and second guiding surfaces are perpendicular to each other.

By this first embodiment of the heat exchanger plate, a heat exchanger plate is obtained which allows for an improved guiding of the heat exchanger plates in a heat exchanger. This allows the heat exchanger plates to be aligned in a more accurate way when assembling the heat exchanger. This will minimize the possibility of damage to the heat exchanger plates and the sealing gasket during the assembly, which may occur when the heat exchanger plates are misaligned during the tightening of the heat exchanger. This will in turn minimize the risk of leakage of the heat exchanger during use.

In an advantageous development of the inventive heat exchanger plate, the guiding sections are provided at the corners of the heat exchanger plate. This allows for a compact guiding means that will be possible to use also on smaller heat exchanger plates.

In an advantageous development of the inventive heat exchanger plate, the guiding section further comprises a third guiding surface and a fourth guiding surface, where the third and fourth guiding surfaces are also perpendicular to each other. The advantage of this is that the guiding of the heat exchanger plates can be improved further.

In an advantageous development of the inventive heat exchanger plate, the first and the third guiding surfaces, and the second and the fourth guiding surfaces are parallel to each other. The advantage of using perpendicular guiding surfaces is that the gap in the transverse direction and the longitudinal direction can be minimized.

In an advantageous development of the inventive heat exchanger plate, the first guiding surface, the second guiding surface the third guiding surfaces and the fourth guiding surfaces are straight guiding surfaces.

In an advantageous development of the inventive heat exchanger plate, the guiding section further comprises a recessed surface being parallel to the basis surface level of the heat exchanger plate, and having a pressing depth that is greater than the corrugated pattern of the heat transfer surface of the heat exchanger plate. This is advantageous in that the guiding surface can be increased, which gives a more accurate alignment of the heat exchanger plates. Another advantage of this is that the guiding surface is increased without extending the guiding surface in the transverse or the longitudinal direction. This allows for a compact guiding means.

In an advantageous development of the inventive heat exchanger plate, the guiding section further comprises a third guiding surface and a fourth surface, where the third and fourth guiding surfaces are also perpendicular to each other. This is advantageous in that the alignment of the heat exchanger plates can be further improved.

In an inventive heat exchanger, the heat exchanger comprises a plurality of heat exchanger plates according to the invention. This allows for a heat exchanger where the guiding of the heat exchanger plates is improved.

BRIEF DESCRIPTION OF DRAWINGS

The invention will be described in greater detail in the following, with reference to the embodiments that are shown in the attached drawings, in which.

MODES FOR CARRYING OUT THE INVENTION

The embodiments of the invention with further developments described in the following are to be regarded only as examples and are in no way to limit the scope of the protection provided by the patent claims.

Figure 1:
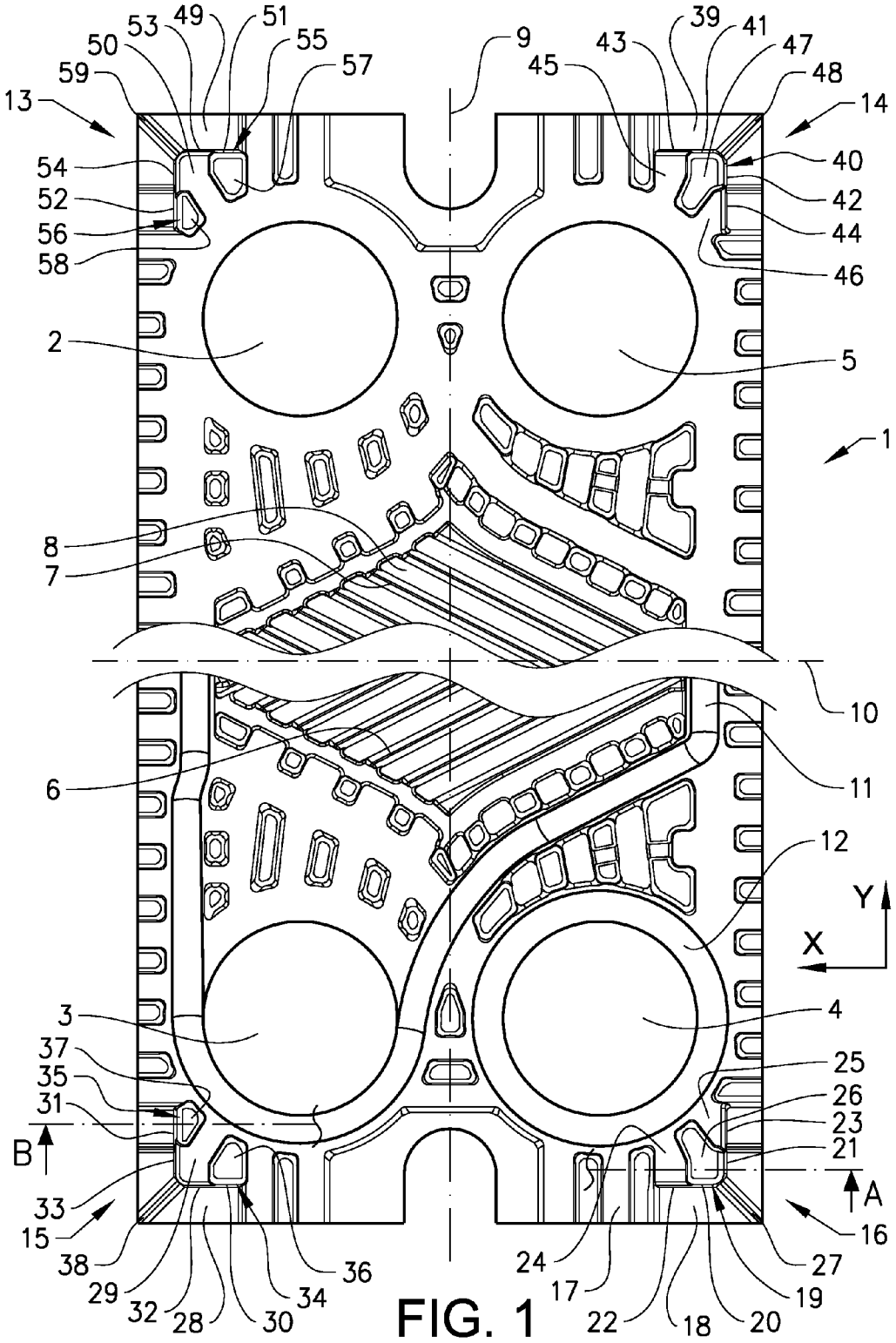
FIG. 1 shows part of a heat exchanger plate according to the invention.
Figure 2:
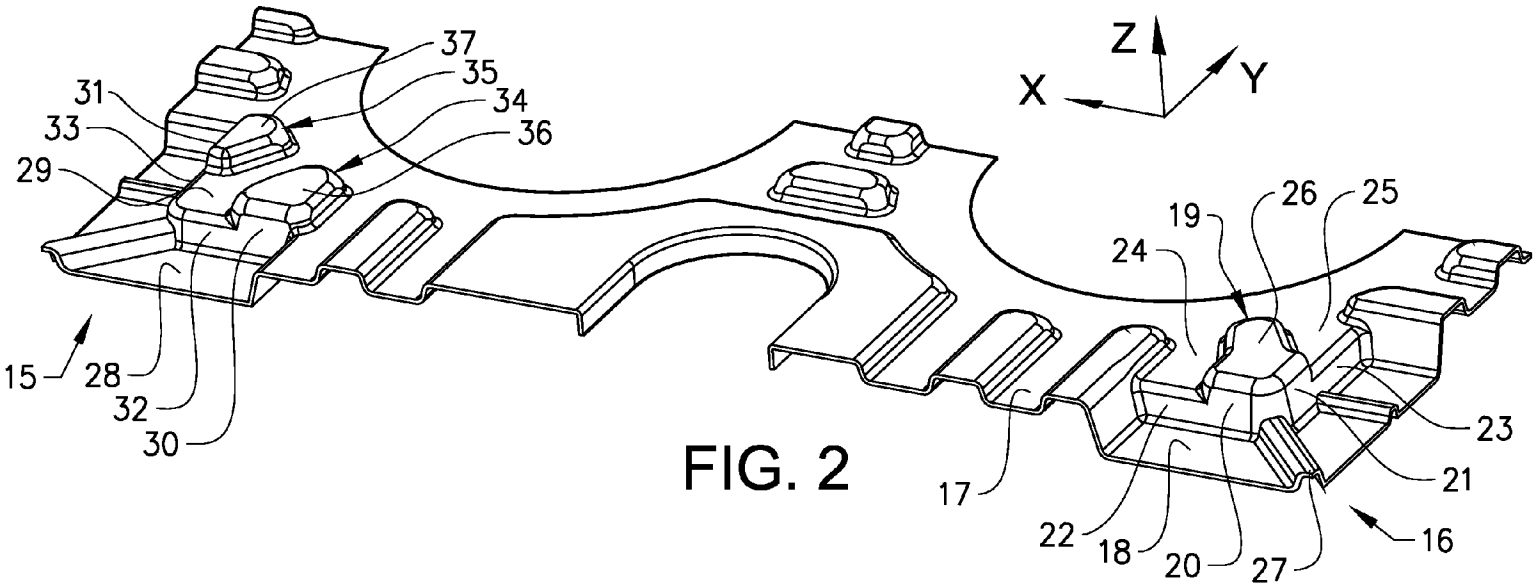
FIG. 2 shows a detail of the heat exchanger plate according to the invention.
Figure 3:
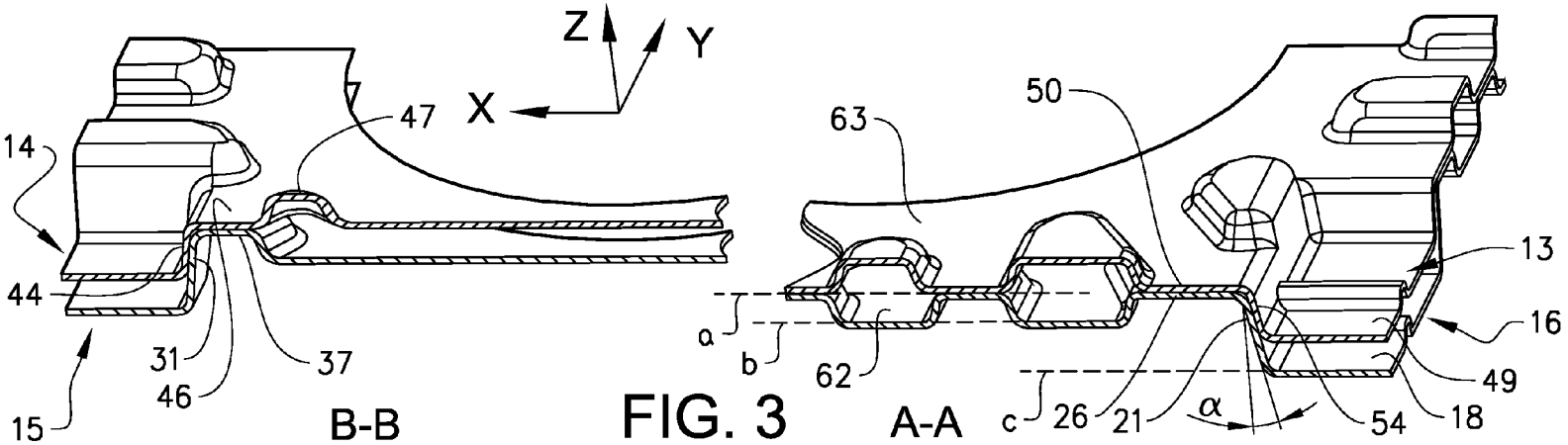
FIG. 3 shows a cross section of two heat exchanger plates according to the invention.

FIG. 1 shows part of a heat exchanger plate according to a first embodiment of the invention. FIGS. 2 and 3 show details of the heat exchanger plate. The heat exchanger plate is intended to be used in heat exchangers for general heating and cooling duties of different liquids throughout industry. Only the end regions of the heat exchanger plate are shown. The heat exchanger plate 1 comprises four port holes 2, 3, 4, 5 that will constitute either inlet ports or outlet ports in the heat exchanger. The shown heat exchanger plate 1 is designed in such a way that one plate type is enough to assemble a heat exchanger. Thus, every other heat exchanger plate 1 is turned upside down with respect to the transversal axis 10 in order to obtain the different flow channels when the heat exchanger is assembled. In this way, portholes 2 and 4 will constitute an active inlet port to a flow channel, and portholes 3 and 5 will constitute a passive port. In this way, the pattern will interact such that the pattern of one plate will bear on the pattern of the other plate, creating a plurality of intermediate contact points.

The heat exchanger plate comprises a corrugated heat transfer surface 6 having a corrugated pattern comprising ridges 7 and valleys 8. The corrugated pattern may have different designs. The end regions of the plate, i.e. the inlet and outlet port regions outside the heat transfer surface, will always be mirror-inverted for a single plate type heat exchanger. The heat exchanger plate comprises sealing gasket grooves, adapted to receive a sealing gasket which is used to define and delimit a flow channel. In FIG. 1, the lower part of the heat exchanger plate is shown with a channel sealing gasket 11 positioned in the gasket groove around the heat transfer surface and a port sealing gasket 12 positioned around a passive port. The function of such heat exchanger plates is well-known to the skilled person and is not described further.

The sealing gasket groove is supported by protruding support knobs pressed in the heat exchanger plate. The support knobs are placed around the periphery of the heat exchanger plate and also in the adiabatic transfer sections of the heat exchanger plate. The support knobs of one section will bear on the areas between the support knobs of another section when the heat exchanger plates are assembled in the heat exchanger. The support knobs may have different shapes. Their main purpose is to stabilize the adiabatic transfer areas, the gasket grooves and the diagonal grooves of the heat exchanger.

Figure 5:
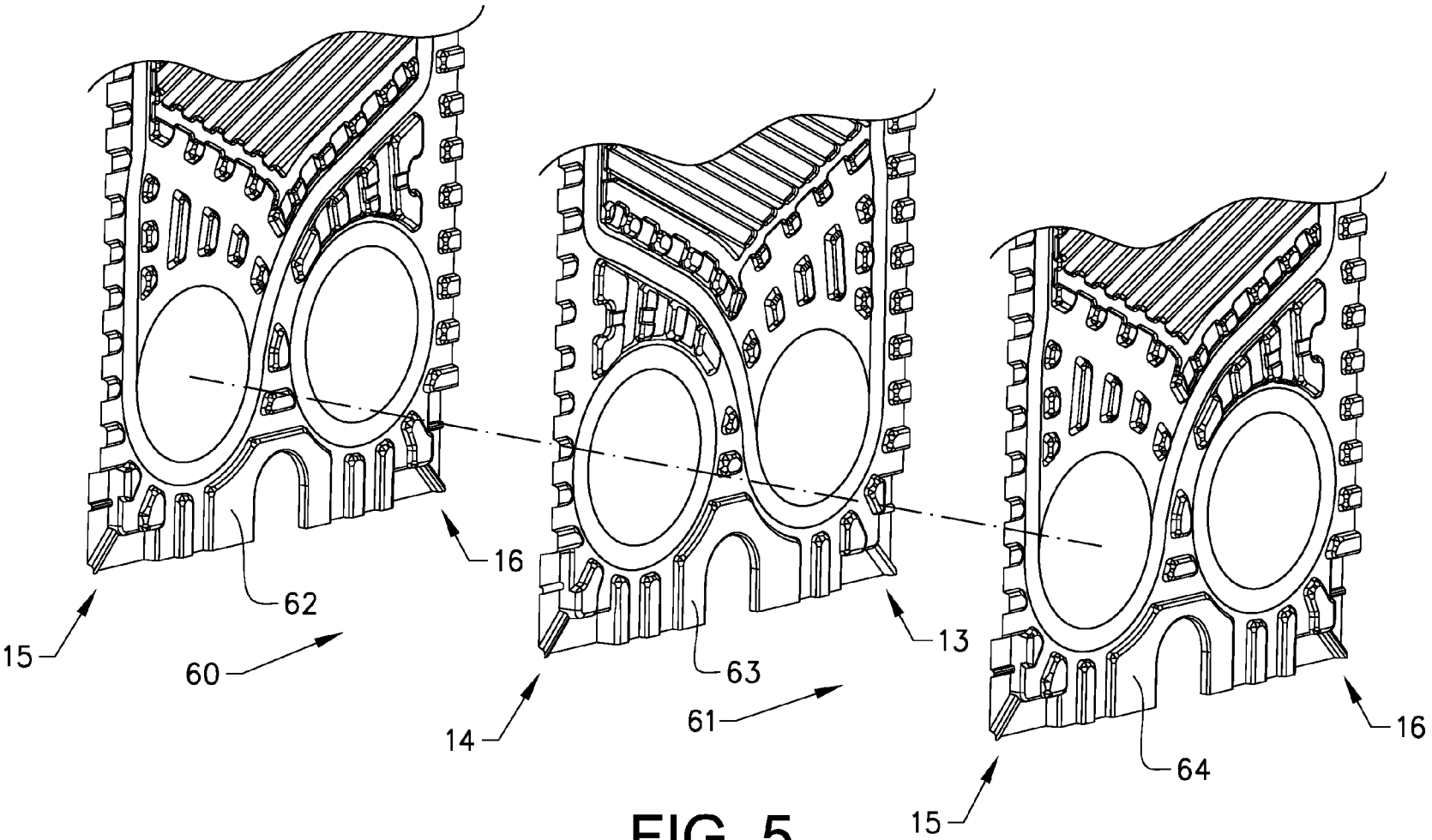
FIG. 5 shows a detail of a heat exchanger according to the invention.

The corner regions of the heat exchanger plate are in the first embodiment provided with guiding sections. A guiding section comprises support knobs and guiding surfaces, where the support knobs and guiding surfaces define guiding structures that are spaced from a perimeter edge of the respective heat exchanger plates as depicted in FIG. 1. The first end of the heat exchanger plate comprises a first guiding section 13 and a second guiding section 14. The second end of the heat exchanger plate comprises a third guiding section 15 and a fourth guiding section 16. Since the heat exchanger plate is mirror-inverted with respect to the transversal axis 10, the guiding sections 13 and 15 are similar, and guiding sections 14 and 16 are similar. In a heat exchanger, when heat exchanger plates are stacked on each other, the rear side of a guiding section will bear on the front side of another guiding section. An example of this is shown in FIG. 5, where a detail of a heat exchanger plate comprising three heat exchanger plates 62, 63, 64 is shown. The rear side of guiding section 13 of heat exchanger plate 63 will bear on the front side of guiding section 16 of exchanger plate 62, and the rear side of guiding section 14 of heat exchanger plate 63 will bear on the front side of guiding section 15 of exchanger plate 62. Likewise, the rear side of guiding section 16 of heat exchanger plate 64 will bear on the front side of guiding section 13 of exchanger plate 63, and the rear side of guiding section 15 of heat exchanger plate 64 will bear on the front side of guiding section 14 of exchanger plate 63.

The fourth guiding section 16 comprises a recessed corner surface 18. The heat exchanger plate 1 is pressed using a pressing tool. The protrusions of the heat exchanger plate 1, comprising the ridges of the heat transfer surface and the support knobs, will thus obtain a first height level a. The valleys of the heat transfer surface and the sealing gasket grooves will obtain a second height level b, corresponding to the normal pressing depth of the plate. The level b is here referred to as the basis surface level. The recessed corner surface 18 is pressed to a third level c, corresponding to the maximum pressing depth of the plate. The difference in height between level b and level c is preferably between one and two pressing depths. It is important that the level c differs from level b by a sufficient amount, in order to allow the guiding surfaces to bear on each other. On the other hand, it is not possible to make the difference between level b and level c very large, since it is not possible to press the material of the heat exchanger plate to any height. The recessed corner surface 18 may be provided with one or several protrusions 27 in order to facilitate the pressing of the recessed corner.

By keeping the difference between level b and level c between one and two pressing depths, the necessary plate material volume needed for the pressing of such a recessed corner is drawn mainly from the corner region. Since the corner region is positioned at the outer edge of the plate material, such a high pressing depth is possible to obtain without deteriorating the strength of the heat exchanger plate. A slight change in the material properties will also be allowed at the corner region, since the corner region of the heat exchanger plate is outside of the pressurized area of the heat exchanger.

The guiding section 16 further comprises a central support knob 19 positioned in the corner of the plate with its longitudinal extension at an angle of 45 degrees with respect to the transversal axis x and the longitudinal axis y of the plate. A first intermediate surface 24 is positioned on one side of the central support knob 19, and a second intermediate surface 25 is positioned on the other side of the central support knob 19. The intermediate surfaces 24, 25 have the height of the basis surface level. The central support knob 19 is provided with a first transverse guiding surface 20 and a first longitudinal guiding surface 21. The outer tip of the central support knob 19 is provided with a radius. The radius is preferably as small as possible, and is determined by the pressing parameters. The guiding section 16 is further provided with a second transverse guiding surface 22 and a second longitudinal guiding surface 23. The second transverse guiding surface 22 is positioned on the vertical surface between the recessed corner surface 18 and the first intermediate surface 24. The second longitudinal guiding surface 23 is positioned on the vertical surface between the recessed corner surface 18 and the second intermediate surface 25.

The guiding surfaces are all inclined in the vertical direction with an angle $\alpha$. The angle $\alpha$ is determined by the pressing parameters, the size of the heat exchanger plate and the required guiding properties. The angle $\alpha$ is preferably in the range between 5 and 20 degrees, but may be up to 30 degrees. In the description, the transversal direction corresponds to the x-axis, the longitudinal direction corresponds to the y-axis and the vertical direction corresponds to the z-axis.

The third guiding section 15 comprises a recessed corner surface 28. The recessed corner surface 28 is pressed to the same height level as the recessed corner surface 18, i.e. to level c. The guiding section 15 further comprises a first support knob 34 and a second support knob 35 positioned on either side of a central surface 29 of the plate. The central surface 29 is positioned with its longitudinal extension at an angle of 45 with respect to the transversal axis and the longitudinal axis of the plate. The central surface 29 has the height of the basis surface level. The recessed corner surface 28 may be provided with one or several protrusions 38 in order to facilitate the pressing of the recessed corner.

The guiding section 15 is provided with a first transverse guiding surface 30 and a first longitudinal guiding surface 31. The first support knob 34 is provided with the first transverse guiding surface 30 and the second support knob 35 is provided with the first longitudinal guiding surface 31. The outer tip of the central surface 29 is provided with a radius. The radius is preferably as small as possible, and is determined by the pressing parameters. The guiding surfaces 30, 31 are also inclined in the vertical direction with the angle $\alpha$. The second transverse guiding surface 32 is positioned on the vertical surface between the recessed corner surface 28 and the central surface 29. The second longitudinal guiding surface 33 is positioned on the vertical surface between the recessed corner surface 28 and the central surface 29.

In the same way, the second guiding section 14 comprises a recessed corner surface 39, also pressed to the third level c. The recessed corner surface 39 may be provided with one or several protrusions 48. The guiding section 14 further comprises a central support knob 47. A first intermediate surface 45 and a second intermediate surface 46 are positioned on the sides of the central support knob 47. The intermediate surfaces 45, 46 have the height of the basis surface level. The central support knob 47 is provided with a first transverse guiding surface 41 and a first longitudinal guiding surface 42. The guiding section 14 is further provided with a second transverse guiding surface 43 and a second longitudinal guiding surface 44. The second transverse guiding surface 43 is positioned on the vertical surface between the recessed corner surface 39 and the first intermediate surface 45. The second longitudinal guiding surface 44 is positioned on the vertical surface between the recessed corner surface 39 and the second intermediate surface 46. Also these guiding surfaces are inclined in the vertical direction with the angle $\alpha$.

The first guiding section 13 comprises a recessed corner surface 49, pressed to the level c. The guiding section 13 further comprises a first support knob 57 and a second support knob 58 positioned on either side of a central surface 50 of the plate. The central surface 50 has the height of the basis surface level. The recessed corner surface 28 may be provided with one or several protrusions 59. The guiding section 13 is provided with a first transverse guiding surface 51 provided on the first support knob 57 and a first longitudinal guiding surface 52 provided on the second support knob 58. The guiding surfaces 51, 52 are also inclined in the vertical direction with the angle $\alpha$. The guiding section 13 is further provided with a second transverse guiding surface 53 and a second longitudinal guiding surface 54. The second transverse guiding surface 53 is positioned on the vertical surface between the recessed corner surface 49 and the central surface 50. The second longitudinal guiding surface 54 is positioned on the vertical surface between the recessed corner surface 49 and the central surface 50.

When two heat exchanger plates are mounted on each other, the rear side of one plate will bear on the front side of another plate. In FIG. 3, an example of two heat exchanger plates 62, 63 mounted to each other is shown. In this example, the first guiding section 13 of the second heat exchanger plate 63 will bear on the fourth guiding section 16 of the first heat exchanger plate 62. At the same time, the second guiding section 14 of the second plate 63 will bear on the third guiding section 15 of the first plate 62. In FIG. 3, the cross-section A-A is shown for the guiding sections 13 and 16, and the cross-section B-B is shown for the guiding sections 14 and 15.

More specifically, for the first guiding section 13 and the fourth guiding section 16, the rear side of the central surface 50 will bear on the upper support surface 26 of the central support knob 19. The rear side of the second longitudinal guiding surface 54 of the second plate 63 will bear on the first longitudinal guiding surface 21 of the first plate 62. At the same time, the rear side of the second transverse guiding surface 53 of the second plate 63 will bear on the first transverse guiding surface 20 of the first plate 62, which is not shown in FIG. 3.

For the second guiding section 14 and the third guiding section 15, the rear side of the intermediate surfaces 46 will bear on the upper support surface 37 of the second support knob 35. The rear side of the intermediate surfaces 45 will bear on the upper support surface 36 of the first support knob 34 (not shown). The rear side of the second transverse guiding surface 43 of the second plate 63 will bear on the first transverse guiding surface 30 of the first plate 62 (not shown). The rear side of the second longitudinal guiding surface 44 of the second plate 63 will bear on the first longitudinal guiding surface 31 of the first plate 62.

The same will apply for the other two corner regions, where the fourth guiding section 16 of the second plate 63 will bear on the first guiding section 13 of the first plate 62, and the third guiding section 15 of the second plate 63 will bear on the second guiding section 16 of the first plate 62 in a similar manner (not shown in FIG. 3 or 5).

The two heat exchanger plates 62, 63 are thus aligned in an improved way, since each guiding surface must only align the heat exchanger plates in one direction. In combination with the recessed corners, appropriately large guiding surfaces are provided, which can align even smaller heat exchanger plates, where there is not enough space for a conventional guiding of the heat exchanger plates.

The guiding surfaces that are intended to align the plates in the transverse direction, i.e. the rear side of guiding surface 54 with guiding surface 21, the rear side of 44 with guiding surface 31, the rear side of guiding surface 23 with guiding surface 54 and the rear side of 33 with guiding surface 42 are perpendicular to the guiding direction. The same applies to the guiding surfaces intended to guide the plates in the longitudinal direction.

The advantage of having a guiding surface that guides the plates only in one direction is that the gap between the guiding surfaces can be minimized. A reduced gap will improve the alignment in that direction. By having two separate, perpendicular guiding surfaces at each corner of the plate, where one surface guides the plate in one direction and the other surface guides the plate in another, perpendicular direction, an improved guiding of the plates is obtained. This will improve the complete heat exchanger.

Most conventional guiding means have curved guiding surfaces at the corners of the heat exchanger plate with a guiding angle of less than 90 degrees. For such a guiding surface, the radial gap may be made fairly small. However, the vertical and the horizontal gap will be larger than the radial gap because the vertical and horizontal distance between the two surfaces is longer than the radial distance. Further, for conventional guiding surfaces, the available guiding surface is relatively small since the corner region must also be stabilized by support knobs, and because of the fact that all pressings on the heat exchanger plates has the same pressing depth. By providing recessed corners, the guiding surfaces can be made larger in the vertical direction, i.e. the z-axis direction. The effective guiding surface is thus improved, without having to enlarge the guiding surface in the transverse or longitudinal direction.

Figure 4:
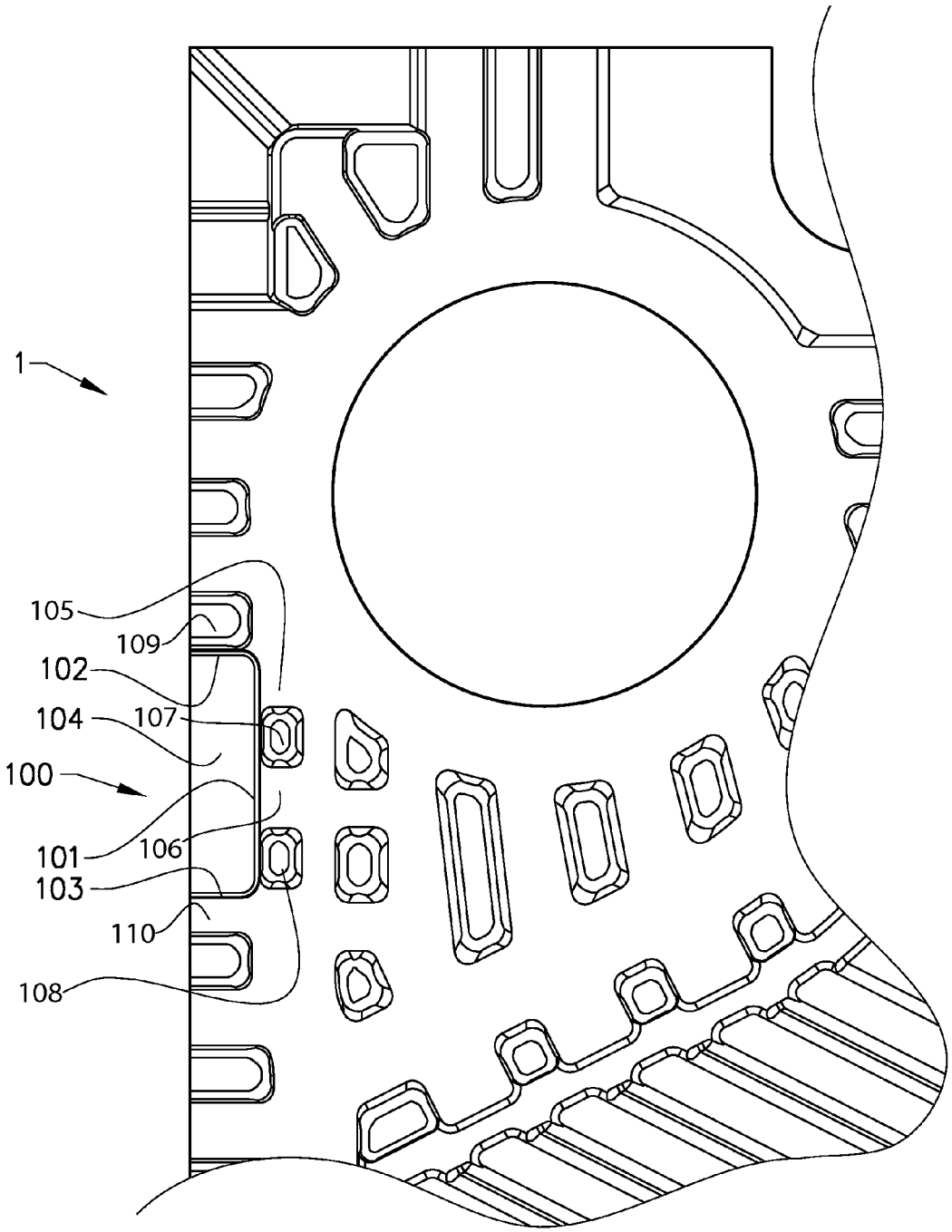
FIG. 4 shows a detail of a second embodiment according to the invention.

In FIG. 4, a second embodiment of the invention is shown. In this embodiment, the heat exchanger plate 1 is provided with a guiding section 100 comprising perpendicular guiding surfaces at the periphery of the heat exchanger plate. Such guiding sections may be provided at different position of the periphery. One suitable position may be close to the port openings of the heat exchanger plate, at the adiabatic surface of the inlet and outlet regions. In this way, the heat transfer surface of the heat exchanger plate will not be influenced. One advantage of this position is also that guiding surfaces will be close to the tightening bolts of the heat exchanger, which will facilitate the guiding of the heat exchanger plates. It is of course also possible to position one or several perpendicular guiding surfaces along the periphery of the heat exchanger, close to the heat transfer surface.

The guiding section 100 comprises a longitudinal guiding surface 101 extending in the longitudinal direction of the heat exchanger plate. A first transverse guiding surface 102 and a second transverse guiding surface 103 extending in the transverse direction of the heat exchanger plate are also comprised in the guiding section 100. These guiding surfaces will also have a slight inclination angle in the vertical direction, due to the pressing process. The guiding section comprises a recessed surface 104 adjacent the guiding surfaces. The recessed surface 104 is preferably pressed to a lower level than the valleys of the heat transfer surface and the sealing gasket grooves. This lower pressing level may be the same as level c described above.

The design of the guiding section 100 corresponds to the design and function of the guiding sections 13-16, having central or intermediate surfaces 105, 106 and having support knobs 107, 108 arranged adjacent to the intermediate surfaces 105, 106.

The longitudinal guiding surface 101 of a second plate will bear on the longitudinal guiding surface 101 of a first plate. At the same time, the rear side of the second transverse guiding surface 103 of the second plate will bear on the first transverse guiding surface 102 of the first plate. In accordance with corner guiding the rear side of the intermediate surface 105 will bear on the surface of the support knob 108, and the rear side of the intermediate surface 106 will bear on the surface of the support knob 107. This is achieved by having the corresponding design and location of the guiding sections 100 on the heat exchanger plate so that when the heat exchanger plate is turned upside down with respect to the transversal axis 10, the intermediate surfaces 105, 106 and support knobs 107, 108 of diagonally arranged guiding sections 100 on the heat exchanger plate will correspond to each other.

Analogously, the rear side of an intermediate surface 110 of the second plate will bear on the surface of the support knob 109 of the first plate.

In a heat exchanger, the rear side of one guiding section will bear on the front side of a corresponding guiding section when the plates are stacked. By using perpendicular guiding surfaces, the transverse and the longitudinal gap can be controlled in a more precise manner, compared to guiding sections comprising a curved surface having a radial gap. The transverse and the longitudinal gap can have different values, depending e.g. on the dimensions of a heat exchanger plate.

In FIG. 5, a part of a heat exchanger comprising three heat exchanger plates 62, 63, 64 is shown. Between the heat exchanger plates, flow channels 60, 61 are created. Each flow channel will carry either a first fluid or a second fluid. In the shown example, first flow channel 60 will carry a first fluid and second flow channel 61 will carry a second fluid. A complete heat exchanger will comprise a plurality of heat exchanger plates, a front plate and a rear plate. The front and rear plate (not shown) will stabilize the heat exchanger and will also provide connection means for the connection of the heat exchanger.

Each flow channel is defined by a sealing gasket that delimits the flow channel between the heat exchanger plates. Sealing gaskets seal the port holes that are not active in the respective flow channel. The sealing gaskets are normally produced in one piece with interconnecting members between the sealing gaskets.

In FIG. 4, it can be seen that, for the first flow channel 60, the rear sides of the first and second guiding sections 13, 14 of the second heat exchanger plate 63 will bear on the fourth respectively the third guiding sections 16, 15 of the first heat exchanger plate 62.

For the second flow channel 61, the rear sides of the fourth and third guiding sections 16, 15 of the third heat exchanger plate 64 will bear on the first respectively the second guiding sections 13, 14 of the second heat exchanger plate 63. In this way, all heat exchanger plates comprised in the heat exchanger will be aligned in an improved way. Due to the improved alignment of the plates, an improved heat exchanger is obtained. The heat exchanger can be disassembled and assembled in a more reliable way, which will reduce the risk of damage to the heat exchanger due to misaligned heat exchanger plates and/or sealing gaskets.

An example of the first guiding surface may be first transverse guiding surface 20, 30, 4L 51, 102. An example of the second guiding surface may be first longitudinal guiding surface 21, 31, 42, 52, 101. An example of the third guiding surface may be second transverse guiding surface 22, 32, 43, 53. An example of the fourth guiding surface may be second transverse guiding surface 23, 33, 44, 54.

In a preferred embodiment, the first guiding surface, the second guiding surface the third guiding surfaces and the fourth guiding surfaces are all straight guiding surfaces.

The invention is not to be regarded as being limited to the embodiments described above, a number of additional variants and modifications of perpendicular guiding surfaces are possible within the scope of the subsequent patent claims.

REFERENCE SIGNS

1: Heat exchanger plate
2: Port hole
3: Port hole
4: Port hole
5: Port hole
6: Heat transfer surface
7: Ridge
8: Valley
9: Longitudinal axis
10: Transverse axis
11: Channel sealing gasket
12: Port sealing gasket
13: First guiding section
14: Second guiding section
15: Third guiding section
16: Fourth guiding section
17: Basis surface level
18: Recessed corner
19: Central support knob
20: First transverse guiding surface
21: First longitudinal guiding surface
22: Second transverse guiding surface
23: Second longitudinal guiding surface
24: First intermediate surface
25: Second intermediate surface
26: Upper support surface
27: Protrusion
28: Recessed corner
29: Central surface
30: First transverse guiding surface
31: First longitudinal guiding surface
32: Second transverse guiding surface
33: Second longitudinal guiding surface
34: First support knob
35: Second support knob
36: First upper support surface
37: Second upper support surface
38: Protrusion
39: Recessed corner
40: Central support knob
41: First transverse guiding surface
42: First longitudinal guiding surface
43: Second transverse guiding surface
44: Second longitudinal guiding surface
45: First intermediate surface
46: Second intermediate surface
47: Upper support surface
48: Protrusion
49: Recessed corner
50: Central surface
51: First transverse guiding surface
52: First longitudinal guiding surface
53: Second transverse guiding surface
54: Second longitudinal guiding surface
55: First support knob
56: Second support knob
57: First upper support surface
58: Second upper support surface
59: Protrusion
60: First flow channel
61: Second flow channel
62: First heat exchanger plate
63: Second heat exchanger plate
64: Third heat exchanger plate
100: Guiding section
101: Longitudinal guiding surface
102: First transverse guiding surface
103: Second transverse guiding surface
104: Recessed surface
105: First intermediate surface
106: Second intermediate surface
107: First support knob
108: Second support knob
109: Support knob
110: Intermediate surface

The invention claimed is:

1. A heat exchanger plate configured to be used together with other heat exchanger plates in a heat exchanger, the heat exchanger plate possessing a perimeter edge and comprising a heat transfer surface having a corrugated pattern with a plurality of ridges and valleys, the heat exchanger plate and said other heat exchanger plates each comprising at least two separated guiding sections, the two separated guiding sections of the heat exchanger plate being of a same configuration as the two separated guiding sections of said other heat exchanger plates, wherein each guiding section comprises a first guiding surface and a second guiding surface, wherein the first and second guiding surfaces are perpendicular to each other, one of the two guiding sections being configured to define a first structure and the other of the two guiding sections being configured to define a second structure, the first and second structures possessing respective configurations different from one another, and the first structure of the heat exchanger plate being configured to be fitted into the second structure of an adjacent heat exchanger plate, where the first guiding structure and the second guiding structure are spaced from the perimeter edge of the heat exchanger plate.

2. The heat exchanger plate according to claim 1, wherein the first guiding surface and the second guiding surface are straight guiding surfaces.

3. The heat exchanger plate according to claim 1 or claim 2, wherein each of the guiding sections is provided at a respective corner of the heat exchanger plate.

4. The heat exchanger plate according to claim 1 or claim 2, wherein the guiding sections further comprise a third guiding surface and a fourth guiding surface, wherein the third and fourth guiding surfaces are also perpendicular to each other.

5. The heat exchanger plate according to claim 4, wherein the third guiding surface and the fourth guiding surface are straight guiding surfaces.

6. The heat exchanger plate according to claim 4, wherein the first and the third guiding surfaces are parallel to each other, and the second and the fourth guiding surfaces are parallel to each other.

7. The heat exchanger plate according to claim 4, wherein the third and fourth guiding surfaces are positioned between a basis surface level and a recessed corner surface.

8. The heat exchanger plate according to claim 1 or claim 2, wherein the guiding sections further comprise a recessed surface being parallel to a basis surface level of the heat exchanger plate, the recessed surface having a pressing depth that is greater than the corrugated pattern of the heat transfer surface of the heat exchanger plate.

9. The heat exchanger plate according to claim 1 or claim 2, wherein the first and second guiding surfaces are comprised on a support knob.

10. The heat exchanger plate according to claim 1 or claim 2, wherein the first and second guiding surfaces are comprised on two different support knobs.

11. A heat exchanger comprising a plurality of heat exchanger plates according to claim 1 or claim 2.

12. The heat exchanger plate according to claim 1, wherein one of the guiding sections includes an upstanding support knob, and including a first surface positioned immediately adjacent one side of the upstanding support knob and recessed relative to the upstanding support knob, and a second surface positioned immediately adjacent an opposite side of the upstanding support knob and recessed relative to the upstanding support knob, the first guiding surface being provided on one side of the upstanding support knob and the second guiding surface being provided on another side of the upstanding support knob.

13. The heat exchanger plate according to claim 1, wherein one of the guiding sections includes first and second spaced apart upstanding support knobs, and including a surface positioned between the first and second spaced apart upstanding support knobs and recessed relative to the first and second spaced apart upstanding support knobs, the first guiding surface being provided on one side of the first upstanding support knob and the second guiding surface being provided on one side of the second upstanding support knob.

14. A heat exchanger comprising a plurality of heat exchanger plates each possessing a perimeter edge, the plurality of heat exchanger plates including a first heat exchanger plate and a second heat exchanger plate that are adjacent to each other, each heat exchanger plate possessing:

a heat transfer surface having a corrugated pattern with a plurality of ridges and valleys, and first and second guiding sections, the first and second guiding sections each having a first guiding surface and a second guiding surface that are perpendicular to each other, the first and second guiding sections defining respective structures, the structure defined by the first guiding section of the first heat exchanger plate being fitted into the structure defined by the second guiding section of the second heat exchanger plate so that the first guiding surface of the first guiding section of the first heat exchanger plate contacts a surface of the second guiding section of the adjacent second heat exchanger plate that is opposite the first guiding surface of the second guiding section of the second heat exchanger plate, and the second guiding surface of the first guiding section of the first heat exchanger plate contacts a surface of the second guiding section of the adjacent second heat exchanger plate that is opposite the second guiding surface of the second guiding section of the second heat exchanger plate to align the first and second heat exchanger plates, where the first guiding structure and the second guiding structure are spaced from the perimeter edge of the respective heat exchanger plate.

15. The heat exchanger according to claim 14, wherein the first guiding surface of the second guiding section of the first heat exchanger plate contacts a surface of the first guiding section of the adjacent second heat exchanger plate that is opposite the first guiding surface of the first guiding section of the second heat exchanger plate, and the second guiding surface of the second guiding section of the first heat exchanger plate contacts a surface of the first guiding section of the adjacent second heat exchanger plate that is opposite the second guiding surface of the first guiding section of the second heat exchanger plate to align the first and second heat exchanger plates in only one direction.

16. The heat exchanger according to claim 14, wherein the first guiding surface and the second guiding surface of each guiding section are straight guiding surfaces.

* * * * *